US009932166B2

(12) United States Patent
Marqua

(10) Patent No.: US 9,932,166 B2
(45) Date of Patent: Apr. 3, 2018

(54) TABLET DISPENSER FOR ATHLETES

(71) Applicant: Salt Mag LLC, Chicago, IL (US)

(72) Inventor: Michael Marqua, Chicago, IL (US)

( * ) Notice: Subject to any disclaimer, the term of this patent is extended or adjusted under 35 U.S.C. 154(b) by 0 days.

(21) Appl. No.: 15/234,480

(22) Filed: Aug. 11, 2016

(65) Prior Publication Data

US 2017/0043939 A1 Feb. 16, 2017

Related U.S. Application Data

(60) Provisional application No. 62/203,479, filed on Aug. 11, 2015.

(51) Int. Cl.
*A47F 1/00* (2006.01)
*G07F 11/00* (2006.01)
*B65D 83/04* (2006.01)

(52) U.S. Cl.
CPC .. *B65D 83/0418* (2013.01); *B65D 2583/0481* (2013.01)

(58) Field of Classification Search
CPC ..... B65D 83/0418; B65D 2583/0481
USPC ..... 221/270, 268, 226, 255, 171, 272, 229, 221/232
See application file for complete search history.

(56) References Cited

U.S. PATENT DOCUMENTS 2,620,061 A * 12/1952 Oskar Uxa ..... A24F 15/16 221/229
2,803,378 A * 8/1957 Gundling ..... A47F 1/06 221/232
3,393,831 A * 7/1968 Stewart ..... A47F 1/06 221/232
3,409,172 A * 11/1968 Fuglsang-Madsen ..... B65D 83/049 221/229
4,589,575 A * 5/1986 Rigberg ..... B65D 83/0418 206/535
5,048,720 A * 9/1991 Hoke ..... B65D 83/0418 221/198
5,178,298 A * 1/1993 Allina ..... B65D 83/0418 206/457
5,230,440 A * 7/1993 Kurokawa ..... B65D 83/0418 221/198
5,244,116 A * 9/1993 Leo ..... A45D 44/00 221/232
5,335,816 A * 8/1994 Kaufman ..... A61J 7/0481 221/124
5,366,112 A * 11/1994 Hinterreiter ..... B65D 83/0418 221/198

(Continued)

*Primary Examiner* — Rakesh Kumar
(74) *Attorney, Agent, or Firm* — Matthew M. Googe; Robinson IP Law, PLLC

(57) ABSTRACT

A portable tablet dispensing device is provided for dispensing tablets to an athlete. The dispensing device includes: an elongate magazine body, a tablet follower positioned within the magazine body, the tablet follower being slidable along a vertical length of the magazine body and a spring positioned between the tablet follower and lower end of the magazine body, the spring configured to urge the tablet follower towards the upper end of the magazine body; a dispensing head slidably mounted to the top elongate body and having a tablet pickup shaped to contact a tablet within the cavity of the dispensing head and urge the tablet towards a front of the tablet dispensing device when the tablet pickup moves from the first position to the second extended position.

6 Claims, 9 Drawing Sheets

(56) References Cited

U.S. PATENT DOCUMENTS 5,649,642 A * 7/1997 Mabry ..... B65D 83/087 221/232
5,785,206 A * 7/1998 Chan ..... G07F 11/14 221/198
5,975,349 A * 11/1999 Menes ..... B65H 1/06 221/232
6,220,479 B1 * 4/2001 Fishman ..... B65D 83/0409 221/24
6,564,967 B1 * 5/2003 Stringfield ..... B65D 83/0418 221/229
6,578,732 B1 * 6/2003 Mabry ..... B65D 83/0829 221/279
6,889,869 B2 * 5/2005 Hallin ..... B65D 83/0418 221/223
6,997,343 B2 * 2/2006 May ..... B65H 1/00 221/232
7,246,720 B1 * 7/2007 Montoya, Jr. ..... A61F 6/005 221/229
7,523,841 B2 * 4/2009 Konig ..... B65D 83/0418 221/197
7,677,409 B2 * 3/2010 Reynolds ..... A61B 5/14532 221/208
7,857,165 B2 * 12/2010 Matsumoto ..... G01D 11/24 221/197
7,935,307 B2 * 5/2011 Angelides ..... C01N 33/48757 422/401
8,523,011 B2 * 9/2013 Haas ..... B65D 83/0418 206/540
9,204,829 B2 * 12/2015 Prais ..... C01N 33/48757
9,383,333 B2 * 7/2016 Reynolds ..... C01N 33/48757
2002/0108963 A1 * 8/2002 Pawlo ..... A61J 7/0409 221/185
2004/0007585 A1 * 1/2004 Griffith ..... C01N 33/48757 221/232
2006/0118435 A1 * 6/2006 Cronin ..... B65D 47/243 206/219
2006/0203878 A1 * 9/2006 Pearl ..... B65H 35/002 374/141
2008/0302814 A9 * 12/2008 Fenton ..... A61F 5/08 221/231
2015/0160186 A1 * 6/2015 Garner-Richards G01N 33/48757 221/270
2017/0043939 A1 * 2/2017 Marqua ..... B65D 83/0418

* cited by examiner

TABLET DISPENSER FOR ATHLETES

CROSS-REFERENCE TO RELATED APPLICATIONS

This application claims priority to U.S. Patent Application Ser. No. 62/203,479 by Michael Marqua for a "Tablet Dispenser for Athletes", which was filed on Aug. 11, 2015, the contents of which are incorporated herein by reference in its entirety.

FIELD

This disclosure relates to the field of athletic equipment. More particularly, this disclosure relates to a tablet dispenser for dispensing tablets, such as salt tablets, to an athlete.

BACKGROUND

Many athletes in training, particularly marathon runners, cyclists, and triathletes, rely on salt tablets or electrolyte tablets to keep their bodies functioning despite massive electrolyte loss due to perspiration. The tablets dissolve quickly and, with copious amounts of drinking water, replenish the athlete's electrolyte balance. Unfortunately, the athletes usually try to take a tablet while running or cycling. Other factors include shaking hands due to exhaustion. The tablets are easily spilled or dropped on the ground, which can be catastrophic during a race. What is needed, therefore, is a tablet dispenser for athletes that easily and securely dispenses a single tablet into the athlete's hand.

SUMMARY

Accordingly, the invention is directed to a tablet dispenser for athletes. The dispenser is rectangular and spring-loaded, in a manner similar to a magazine in a semi-automatic pistol, and easily and securely dispenses a single tablet into the athlete's hand. This prevents the tablets from being dropped or spilled at a critical moment. On its left side surface, the dispenser provides a transparent cover such that the user may easily see how many tablets are left in the dispenser. A removable belt clip mount and bicycle frame mount are provided.

In a first aspect, a portable tablet dispensing device is provided including: an elongate magazine body having an upper end, lower end, and a substantially rectangular cross-sectional area along a length of the magazine body, the magazine body including a tablet follower positioned within the magazine body, the tablet follower including a surface area and having a rectangular cross-sectional area that conforms to a cross-sectional area of the magazine body, the tablet follower being slidable along a vertical length of the magazine body between a lower position adjacent the lower end of the magazine body and an upper position adjacent the upper end of the magazine and a spring positioned between the tablet follower and lower end of the magazine body, the spring configured to urge the tablet follower towards the upper end of the magazine body; a dispensing head slidably mounted to the open top end of the elongate body, the dispensing head horizontally slidable between a first position and a second extended position, the dispensing head including an aperture formed in a front of the dispensing head, the aperture having a cross-sectional area corresponding to a shape of a tablet stored within the magazine body, a cavity within the dispensing head shaped to receive a tablet from the magazine body, and a tablet pickup shaped to contact a tablet within the cavity of the dispensing head and urge the tablet towards a front of the tablet dispensing device when the tablet pickup moves from the first position to the second extended position.

In one embodiment, the portable tablet dispensing device further includes a tablet retainer attached to the upper end of the magazine body, the tablet retainer having a pair of upright members extending from the upper end of the magazine body and a top member extending between the pair of upright members, wherein the tablet retainer substantially traps a tablet between the pair of upright members, top member, and tablet follower until the dispensing head urges the tablet towards a front of the tablet dispensing device.

In another embodiment, the portable tablet dispensing device further includes a tablet sleeve slidabable between a first position within the magazine body and a second position extended from the upper end of the magazine body, wherein the dispensing head is slidably mounted to an upper end of the tablet dispensing sleeve.

In yet another embodiment, the portable tablet dispensing device includes one or more viewing windows formed along a vertical length of the magazine body.

In one embodiment, the viewing windows are located at positions corresponding to a known number of tablets contained within the tablet dispensing device.

In another embodiment, the magazine body further comprises an ergonomically shaped front portion for conforming to a shape of a user's hand.

In a second aspect, a portable tablet dispensing device is provided having: an elongate magazine body having an upper end, lower end, and a substantially rectangular cross-sectional area along a length of the magazine body, the magazine body including a tablet follower positioned within the magazine body, the tablet follower including a surface area and having a rectangular cross-sectional area that conforms to a cross-sectional area of the magazine body, the tablet follower being slidable along a vertical length of the magazine body between a lower position adjacent the lower end of the magazine body and an upper position adjacent the upper end of the magazine and a spring positioned between the tablet follower and lower end of the magazine body, the spring configured to urge the tablet follower towards the upper end of the magazine body; a tablet sleeve slidabable between a first position within the magazine body and a second position extended from the upper end of the magazine body; a tablet retainer attached to an upper end of the tablet sleeve, the tablet retainer having a pair of upright members extending from the upper end of the magazine body and a top member extending between the pair of upright members, wherein the tablet retainer substantially traps a tablet between the pair of upright members, top member, and tablet follower; a dispensing head slidably mounted to an upper end of the tablet sleeve, the dispensing head horizontally slidable between a first position and a second extended position, the dispensing head including an aperture formed in a front of the dispensing head, the aperture having a cross-sectional area corresponding to a shape of a tablet stored within the magazine body, a cavity within the dispensing head shaped to receive a tablet from the magazine body, and a tablet pickup shaped to contact a tablet within the cavity of the dispensing head and urge the tablet towards a front of the tablet dispensing device when the tablet pickup moves from the first position to the second extended position.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1:
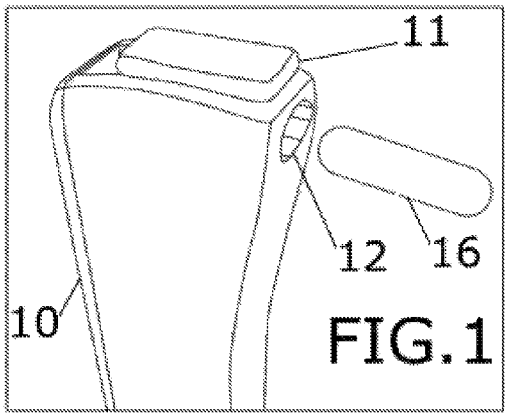
FIG. 1 is a front perspective view of the first exemplary embodiment dispensing a tablet, displaying the dispenser 10, the thumb switch 11, the aperture 12, and the tablet 16.
Figure 3:
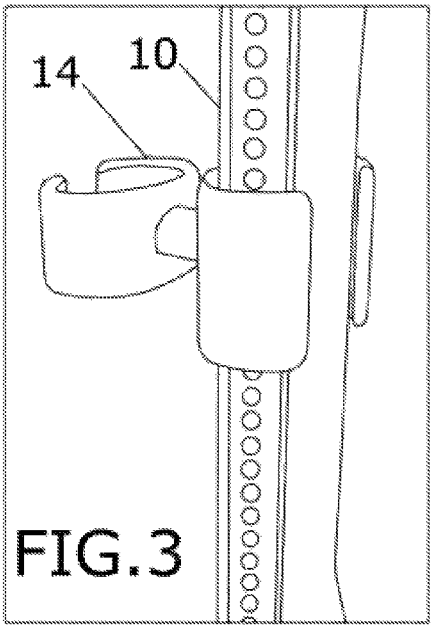
FIG. 3 is a left side perspective view of the first exemplary embodiment with the bicycle frame mount affixed, displaying the dispenser 10, and the bicycle frame mount 14.
Figure 2:
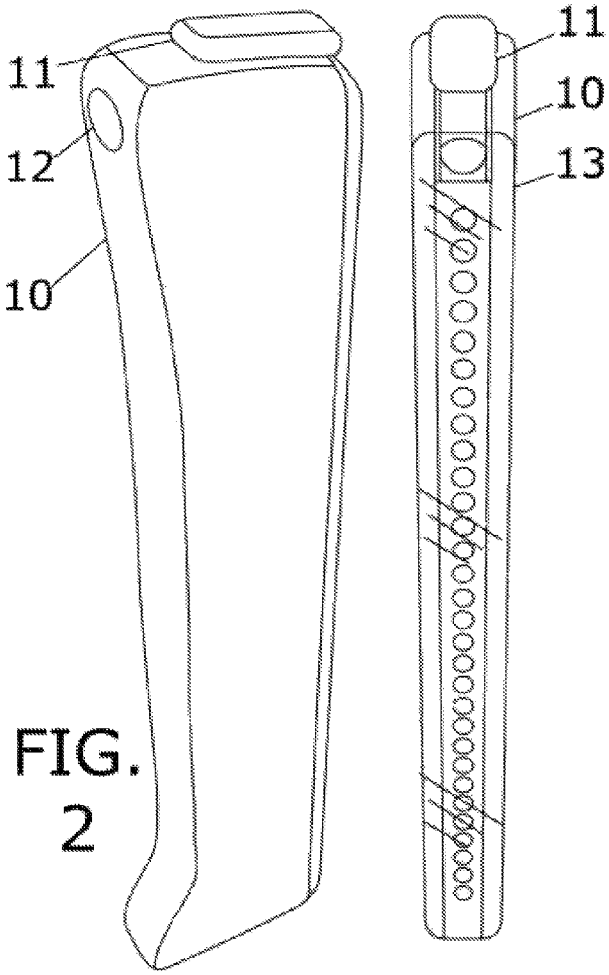
FIG. 2 shows is a rear perspective view and a left side view of the first exemplary embodiment, displaying the dispenser 10, the thumb switch 11, the aperture 12, and the cover 13.
Figure 4:
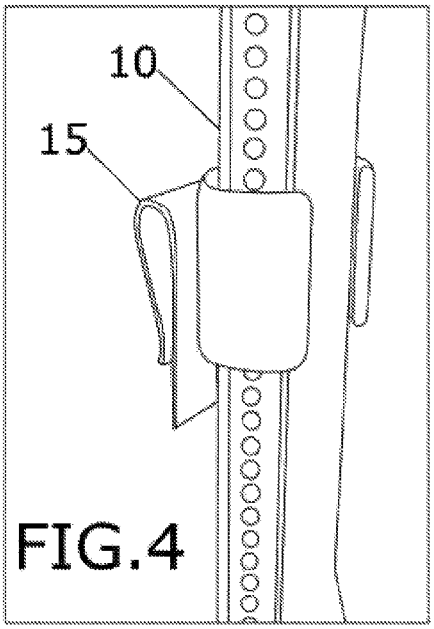
FIG. 4 is a left side perspective view of the first exemplary embodiment with the belt clip mount affixed, displaying the dispenser 10, and the belt clip mount 15.
Figure 5:
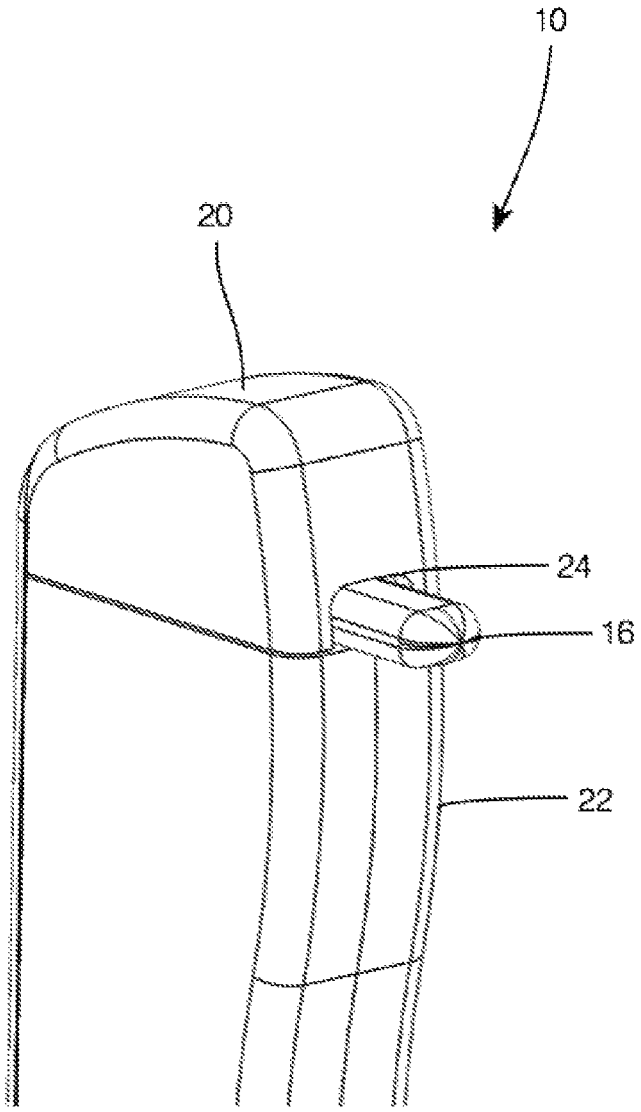
FIG. 5 is a perspective view of a tablet dispenser according to one embodiment of the present disclosure.

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

A tablet dispenser 10 for athletes is provided for readily dispensing a tablet, such as a salt tablet, to an athlete during training or competition. The tablet dispenser 10 dispenses an individual tablet to an athlete and maintains additional tablets within the tablet dispenser 10 for consumption by the athlete.

It is to be understood that while the tablet dispenser 10 is intended for use by athletes, this is not intended as a limitation. With suitable modifications or with no modifications at all, the tablet dispenser may be used by other persons responsible for the care of athletes, such as athletic trainers, and by other individuals whose work or physical activity levels cause them to perspire profusely and lose electrolytes, such as laborers, agricultural workers, firefighters, and infantrymen, Marines, and other military personnel.

The first exemplary embodiment includes a dispenser 10 that is rectangular and spring-loaded, in a manner similar to the magazine in an automatic pistol, and easily and securely dispenses a single tablet 16 into the athlete's hand from a circular aperture 12, provided on the right side surface near the top. This prevents the tablets from being dropped or spilled at a critical moment. On a left side surface of the tablet dispenser 10, a transparent cover 13 is provided with a numbered viewing window, such that the user may view how many tablets 16 are left in the dispenser 10. A removable belt clip mount 15 and bicycle frame mount 14 are also provided.

The tablet dispenser 10 is operated by a thumb switch 11 on the top surface, which releases a lateral coil spring to eject the uppermost tablet 16 through the aperture 12. A vertical leaf spring then urges the coil spring back into its loaded position and feeds a column of tablets 16 upward. Preferably, the dispenser 10 is capable of holding and dispensing up to 30 tablets 16, and is easily reloaded by pressing the leaf spring downward.

To use the first exemplary embodiment, the user may affix either the bicycle frame mount 14 or the belt clip mount 15 to the dispenser 10, then use the mount to affix the dispenser 10 to a bicycle's frame or handlebars, or the user's belt. As desired, the user may press the thumb switch 11 to dispense a tablet 16 through the aperture 12.

The dispenser 10, the thumb switch 11, the bicycle frame mount 14, and the belt clip mount 15 are preferably manufactured from rigid, durable materials which are substantially waterproof, such as steel, aluminum alloy, acrylic polymer, and plastic. The cover 12 is preferably manufactured from a rigid, durable material which is shatterproof and transparent, such as plastic or malacrylate.

Referring now to FIGS. 5-18, in one embodiment the tablet dispenser 10 includes a dispensing head 20 that is slidable relative to an elongate magazine 22 of the tablet dispenser 10. Tablets 16 are individually dispensed from an aperture 24 formed in a front portion of the dispensing head 20.

The elongate magazine 22 includes an upper end 26 and a lower end 28, and has a cross-sectional area that is substantially an elongate rectangle. A cross-sectional area of the magazine 22 is sized such that a plurality of tablets 16, and preferably pill-shaped salt tablets, fit within an interior of the magazine 22. The tablets 16 are arranged such that the tablets 16 are individually stacked on top of one another within the magazine 22. The magazine 22 includes a shaped front portion 30 having one or more indentations such that the magazine 22 conforms to an athlete's hand and fingers when grasping the tablet dispenser 10.

A tablet follower 32 is positioned within the magazine 22 below the tablets 16. The follower 32 includes a flat surface 34 (FIG. 11) that is adjacent to the tablets 16 and that is shaped to contact the tablets 16 within the magazine body 22. The tablet follower 32 may include one or more guide tabs 36 that fit within corresponding slots on an interior of the magazine 22. A hollow post 37 is positioned below and extends the flat surface of the follower 32. The tablet follower 32 is slidably secured within the magazine 22 such that the tablet follower is slidable between a first compressed position wherein the follower 32 is adjacent the lower end of the magazine 22 and a second extended position wherein the follower 34

Figure 6:
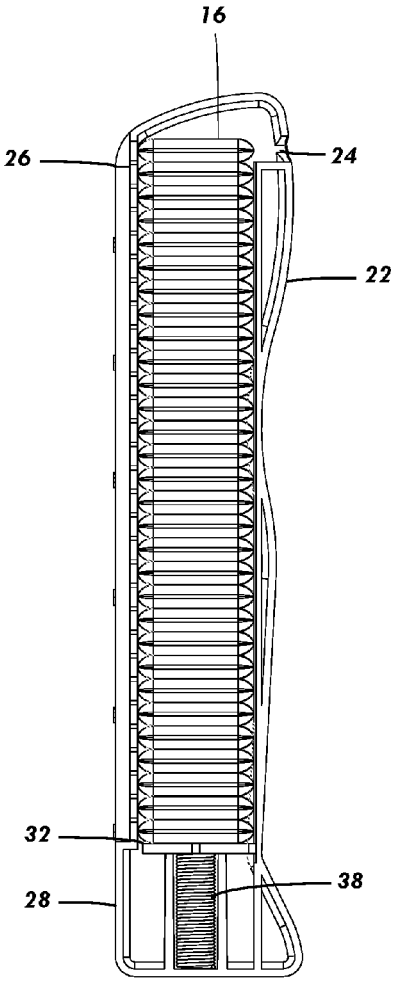
FIG. 6 is a cross-sectional side view of a tablet dispenser according to one embodiment of the present disclosure.
Figure 7:
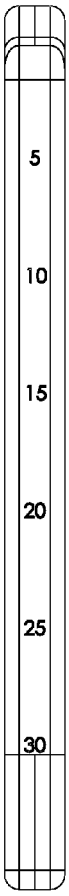
FIG. 7 is a rear view of a tablet dispenser according to one embodiment of the present disclosure.
Figure 8:
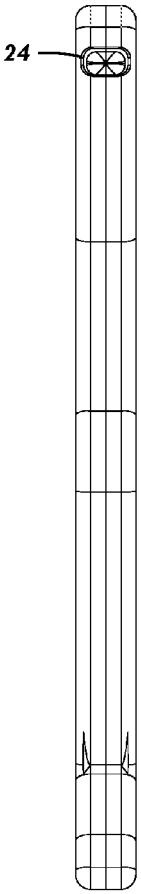
FIG. 8 is a front view of a tablet dispenser according to one embodiment of the present disclosure.
Figure 9:
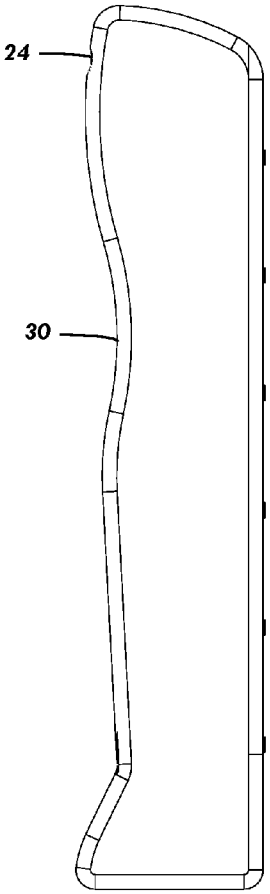
FIG. 9 is a side view of a tablet dispenser according to one embodiment of the present disclosure.
Figure 10:
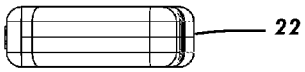
FIG. 10 is a top view of a tablet dispenser according to one embodiment of the present disclosure.
Figure 11:
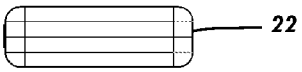
FIG. 11 is a bottom view of a tablet dispenser according to one embodiment of the present disclosure.
Figure 12:
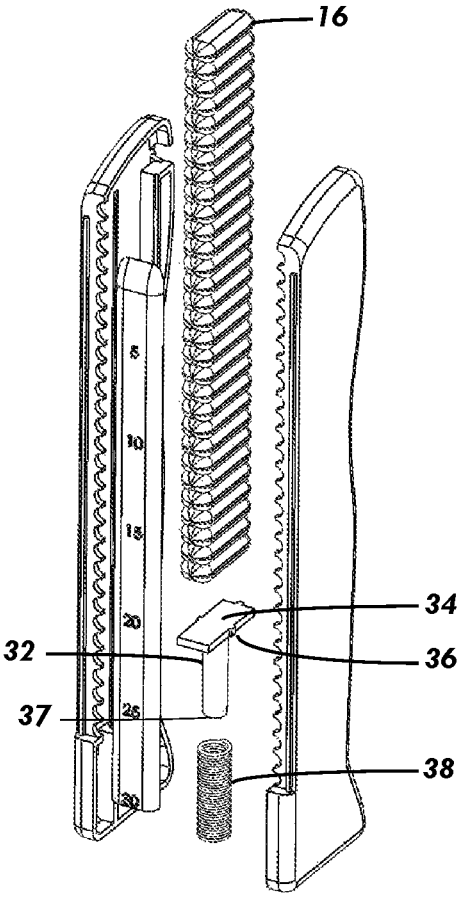
FIG. 12 is an exploded view of a tablet dispenser according to one embodiment of the present disclosure.
Figure 13:
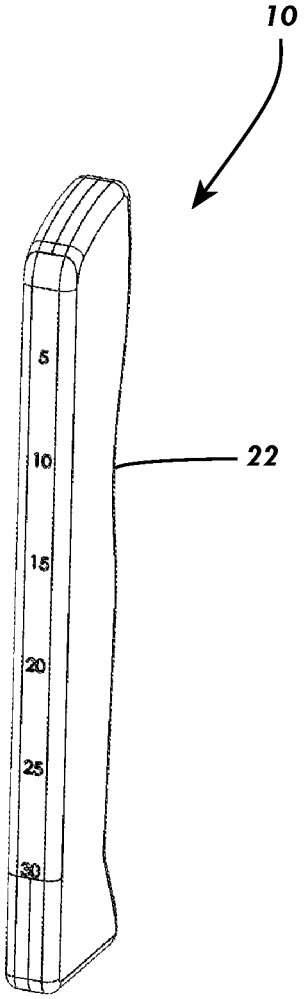
FIG. 13 is a perspective rear view of a tablet dispenser according to one embodiment of the present disclosure.

A spring 38 is positioned between a bottom of the magazine 22 and the tablet follower 32. The spring 38 is preferably in compression such that the follower 32 is urged from the first compressed position towards the second extended position adjacent the upper end of the magazine 22. The spring 38 may fit within the hollow post 37 of the follower 32 when the follower is in the first compressed position, as illustrated in FIG. 6.

Figure 14:
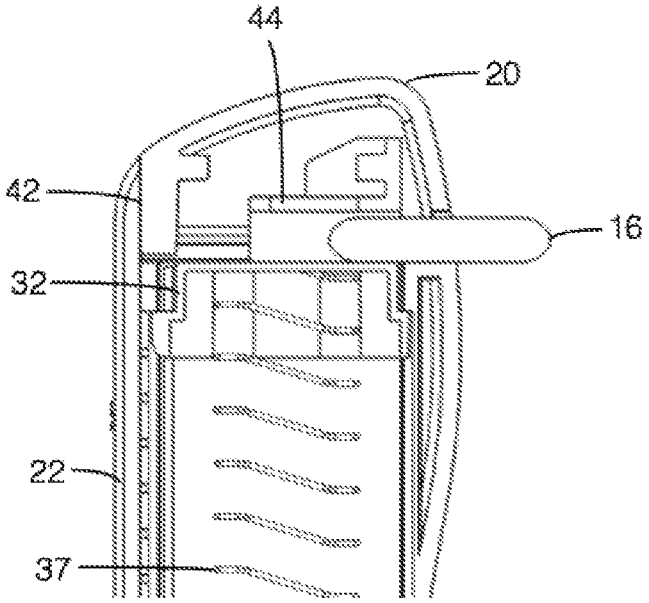
FIGS. 14 and 15 are cross-sectional side views of a dispensing head of a tablet dispenser according to one embodiment of the present disclosure.
Figure 15:
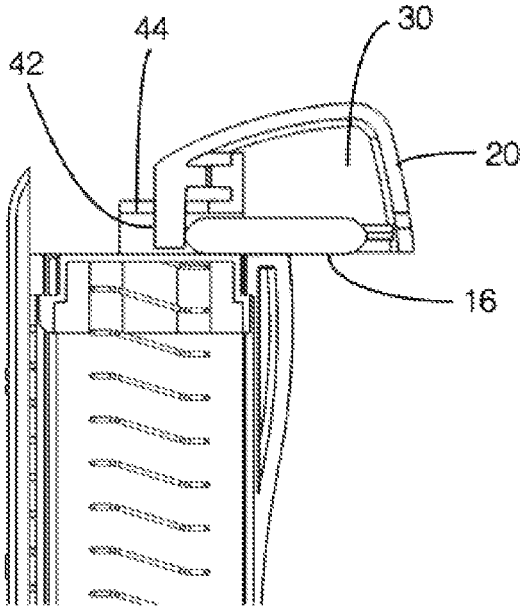
Figure 16:
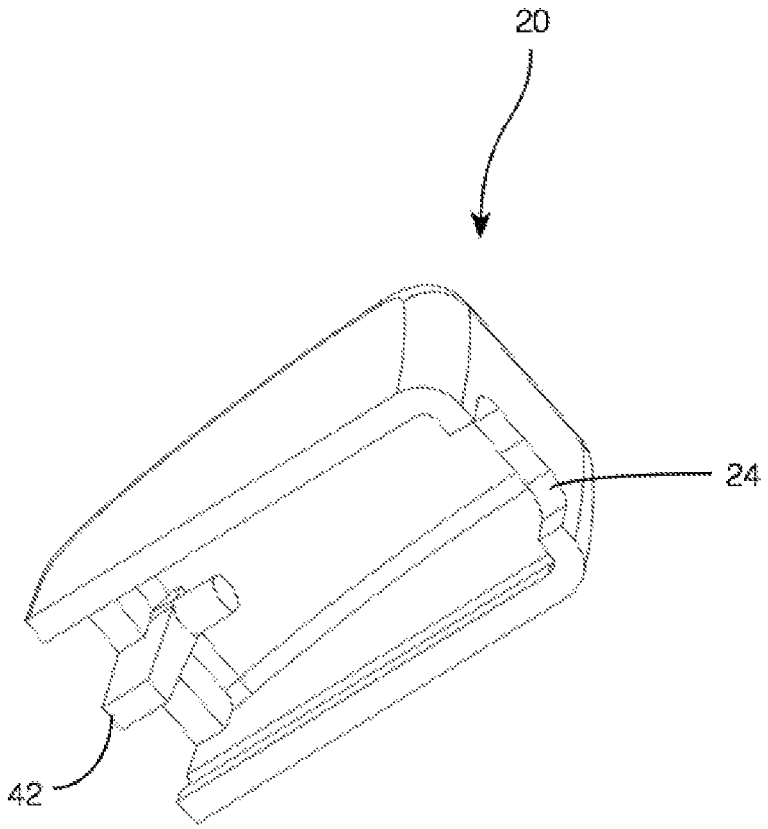
FIG. 16 is a perspective view of a dispensing head of a tablet dispenser according to one embodiment of the present disclosure.

Referring now to FIGS. 14 and 15, the dispensing head 20 is slidably mounted to the upper end of the magazine 22. The dispensing head 20 horizontally slides between a first dispensing position (FIG. 14) wherein the dispensing head 20 is substantially aligned over the magazine 22 and a second dispensing position (FIG. 15) wherein the dispensing head 20 is extended from a front portion of the tablet dispenser 10. The dispensing head 20 may be slidably mounted to the magazine 22 using one or more guide rails and grooves formed in the dispensing head 20 and magazine 22. A spring or other like mechanism may also be included that urges the dispensing head 20 towards the first dispensing position such that after the dispensing head 20 is moved to the second dispensing position the dispensing head is pulled back to the first dispensing position over the magazine 22.

The dispensing head 20 includes the aperture 24 formed in a front portion of the dispensing head, the aperture 24 sized to allow a tablet 16 from within the magazine to pass through the dispensing head 20. The dispensing head 20 is substantially hollow such that a cavity 40 is formed within the dispensing head 20 that is shaped to receive at least one tablet 16 from the magazine 22.

A tablet pickup 42 (FIG. 16) is formed in the dispensing head 20, the tablet pickup 42 shaped to contact a tablet 16 and urge the tablet 16 towards a front portion of the tablet dispenser 10. The dispensing head 20 may also include one or more cutouts that allow the dispensing head 20 to slide with respect to the magazine 22.

Figure 17:
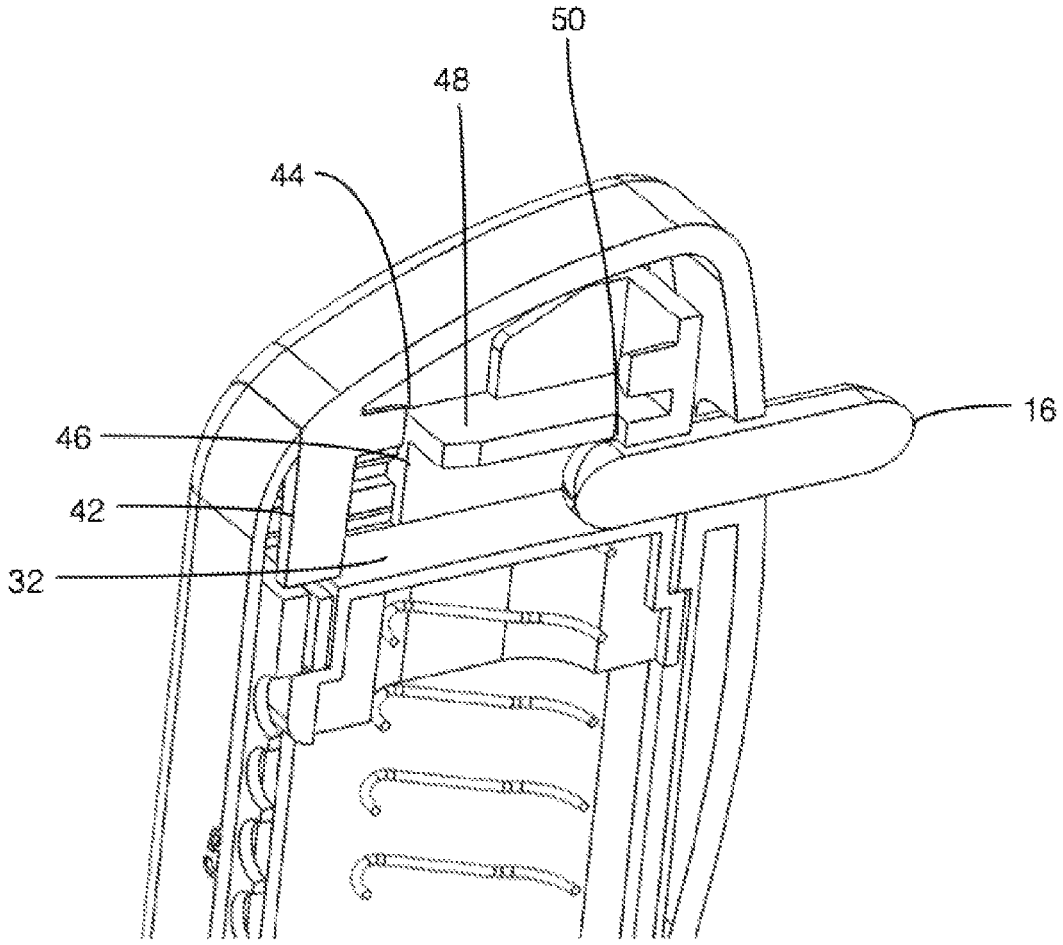
FIG. 17 is a perspective cross-sectional view of a dispensing head of a tablet dispenser according to one embodiment of the present disclosure.
Figure 18:
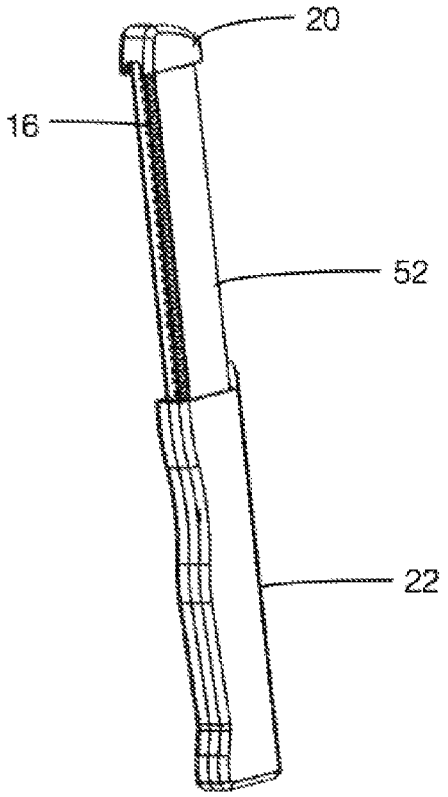
FIG. 18 is a side view of a tablet dispenser according to one embodiment of the present disclosure.

Referring again to FIGS. 14 and 15, the tablet dispenser 10 may include a tablet retainer 44 attached adjacent the upper end of the magazine 22. FIG. 17 illustrates a cross-sectional side view of the tablet retainer 44. The tablet retainer 44 includes at least one upright member 46 extending upward from the magazine 22. A top member 48 is attached to the upright member 46 and is positioned substantially parallel to the tablet follower 32. A slot 50 may be formed in the top member 48 of the tablet retainer 44, the slot 50 shaped to allow the tablet pickup 42 to pass through the slot 50 to urge the tablet 16 towards a front of the dispenser 10, as discussed in greater detail below. The tablet retainer 44 substantially secures an individual tablet between the top member 48 and the follower 32 until the dispensing head 20 urges the tablet out of the aperture 24 in the front of the dispenser 10.

In one embodiment, the tablet dispenser 10 includes a sleeve 52 (FIG. 18) that is slidably inserted into the magazine 22. The sleeve 52 is shaped to receive a plurality of tablets 16. The sleeve 52 is movable between a first position wherein the sleeve 52 is disposed within the magazine 22 and a second position wherein the sleeve 52 is extended out of the magazine 22 for loading of tablets 16 into the sleeve 52. The dispensing head 20 and tablet retainer 44 may be mounted to an upper end of the sleeve 52 such that when the sleeve is in the first position the dispensing head 20 and tablet retainer 44 are adjacent an upper end of the magazine.

In one embodiment, the magazine 22 includes one or more windows formed in the magazine 22 such that an athlete may view how many tablets 16 are within the dispenser 10. The windows may include a marking or other indication of how many tablets are contained within the dispenser. Alternatively, all or a portion of the magazine may be formed of a translucent material that allows an athlete to view tablets within the dispenser.

In operation, one or more tablets are loaded into the dispenser. An athlete carries the tablet dispenser during training or during competition in an athletic event. When an athlete desires to ingest a tablet, the athlete moves the dispensing head from the first position to the second dispensing position. As the dispensing head moves forward, the tablet pickup contacts a tablet within the dispensing head and urges the tablet at least partially out from a front of the dispenser. The dispensing head is then returned to the first position, thereby revealing the tablet from the front of the dispenser. The athlete may then remove and ingest the tablet. After the tablet is ejected, the follower urges another tablet upward toward the dispensing head, thereby readying the next tablet for consumption by the athlete.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A portable tablet dispensing device comprising:

an elongate magazine body having an upper end, lower end, and a substantially rectangular cross-sectional area along a length of the elongate magazine body, the elongate magazine body including:

a tablet follower positioned within the magazine body, the tablet follower including a surface area and having a rectangular cross-sectional area that conforms to a cross-sectional area of the magazine body, the tablet follower being slidable along a vertical length of the magazine body between a lower position adjacent the lower end of the magazine body and an upper position adjacent the upper end of the elongate magazine body and a spring positioned between the tablet follower and lower end of the magazine body, the spring configured to urge the tablet follower towards the upper end of the elongate magazine body;

a hollow dispensing head slidably mounted to the open top end of the elongate body, the hollow dispensing head horizontally slidable between a first position and a second extended position, the hollow dispensing head including:

an aperture formed through a front of the hollow dispensing head, the aperture having a cross-sectional area corresponding to a shape of a tablet stored within the elongate magazine body, a cavity within the hollow dispensing head and aligned with the aperture formed through the front of the hollow dispensing head, the cavity shaped to receive a tablet from the elongate magazine body within hollow the dispensing head, and a tablet pickup comprising an inclined wedge extending downwardly, shaped to contact a tablet within the cavity of the hollow dispensing head and urge the tablet partially towards a front of the tablet dispensing device when the hollow dispensing head moves from the first position to the second extended position, the inclined wedge positioned at a center of the cavity within the hollow dispensing head at a rear of the tablet follower;

a tablet retainer attached to the upper end of the elongate magazine body, the tablet retainer having a pair of upright members extending above the upper end of the elongate magazine body and into the hollow dispensing head and a top member extending between the pair of upright members;

wherein the tablet within the cavity of the dispensing head is partially exposed from the portable tablet dispensing device through the aperture formed in the front of the dispensing head after the dispensing head returns to the first position; and wherein the tablet retainer substantially traps a tablet between the pair of upright members, top member, and tablet follower until the dispensing head urges the tablet towards a front of the tablet dispensing device.

2. The portable dispensing device of claim 1, wherein the elongate magazine body further comprises a shaped front portion including one or more indentations for conforming to a shape of a user's hand.

3. The portable tablet dispensing device of claim 1, further comprising a tablet sleeve slidabable between a first position within the elongate magazine body and a second position extended from the upper end of the elongate magazine body, wherein the hollow dispensing head is slidably mounted to an upper end of the tablet dispensing sleeve.

4. The portable tablet dispensing device of claim 1, further comprising one or more viewing windows formed along a vertical length of the elongate magazine body.

5. The portable tablet dispensing device of claim 4, wherein the viewing windows are located at positions corresponding to a known number of tablets contained within the tablet dispensing device.

6. A portable tablet dispensing device comprising:

an elongate magazine body having an upper end, lower end, and a substantially rectangular cross-sectional area along a length of the elongate magazine body, the elongate magazine body including a tablet follower positioned within the elongate magazine body, the tablet follower including a surface area and having a rectangular cross-sectional area that conforms to a cross-sectional area of the elongate magazine body, the tablet follower being slidable along a vertical length of the elongate magazine body between a lower position adjacent the lower end of the elongate magazine body and an upper position adjacent the upper end of the elongate magazine body and a spring positioned between the tablet follower and lower end of the elongate magazine body, the spring configured to urge the tablet follower towards the upper end of the elongate magazine body;

a tablet sleeve slidabable between a first position within the elongate magazine body and a second position extended from the upper end of the elongate magazine body;

a tablet retainer attached to an upper end of the tablet sleeve, the tablet retainer having a pair of upright members extending from the upper end of the magazine body and a top member extending between the pair of upright members, wherein the tablet retainer substantially traps a tablet between the pair of upright members, top member, and tablet follower;

a hollow dispensing head slidably mounted to an upper end of the tablet sleeve, the hollow dispensing head horizontally slidable between a first position and a second extended position, the hollow dispensing head including an aperture formed through a front of the dispensing head, the aperture having a cross-sectional area corresponding to a shape of a tablet stored within the elongate magazine body, a cavity within the hollow dispensing head shaped to receive a tablet within the hollow dispensing head from the elongate magazine body, and a tablet pickup comprising an inclined wedge extending downwardly, shaped to contact a tablet within the cavity of the hollow dispensing head and urge the tablet partially towards a front of the tablet dispensing device when the hollow dispensing head moves from the first position to the second extended position, the inclined wedge positioned at a center of the cavity within the hollow dispensing head at a rear of the tablet follower;

a tablet retainer attached to the upper end of the elongate magazine body, the tablet retainer having a pair of upright members extending above the upper end of the elongate magazine body and into the dispensing head and a top member extending between the pair of upright members;

wherein the tablet within the cavity of the hollow dispensing head is partially exposed from the portable tablet dispensing device through the aperture formed in the front of the hollow dispensing head and between the tablet retainer and tablet follower after the hollow dispensing head returns to the first position.

* * * * *